US008354968B1

(12) United States Patent
Paulsen et al.

(10) Patent No.: US 8,354,968 B1
(45) Date of Patent: Jan. 15, 2013

(54) BOXED FEED FOR IMPROVED HIGH FREQUENCY (HF) SHUNT ANTENNA PERFORMANCE

(76) Inventors: Lee M. Paulsen, Cedar Rapids, IA (US); Christopher Meehan, Melbourne, FL (US)

( * ) Notice: Subject to any disclaimer, the term of this patent is extended or adjusted under 35 U.S.C. 154(b) by 412 days.

(21) Appl. No.: 12/756,238

(22) Filed: Apr. 8, 2010

(51) Int. Cl.
*H01Q 1/28* (2006.01)

(52) U.S. Cl. ..... 343/705; 343/708; 343/700 MS

(58) Field of Classification Search ..... 343/700 MS, 343/705, 708, 846, 848
See application file for complete search history.

(56) References Cited

U.S. PATENT DOCUMENTS 2,949,606 A * 8/1960 Dorne ..... 343/708
5,610,620 A * 3/1997 Stites et al. ..... 343/725
6,653,980 B2 * 11/2003 Ceccom et al. ..... 343/705
6,683,570 B2 * 1/2004 Skladany et al. ..... 343/700 MS
7,274,336 B2 * 9/2007 Carson ..... 343/705
7,511,674 B2 * 3/2009 McNutt ..... 343/705
7,737,898 B2 * 6/2010 Hanusa et al. ..... 343/708

* cited by examiner

*Primary Examiner* — Tho G Phan
(74) *Attorney, Agent, or Firm* — Donna P. Suchy; Daniel M. Barbieri

(57) ABSTRACT

The present invention is directed to a High Frequency (HF) shunt antenna which promotes improved performance over currently available antenna solutions. The HF shunt antenna may include a shunt plate structure which includes multiple shunt plates configured in a parallel orientation relative to each other and provides an expansive surface area which may promote reduced inductance and lower equivalent parallel resistance of the HF shunt antenna, thereby allowing the HF shunt antenna to be spec-compliant and tunable by a HF coupler, without increasing the footprint of the HF shunt antenna and without reducing radiation efficiency of the antenna.

19 Claims, 4 Drawing Sheets

BOXED FEED FOR IMPROVED HIGH FREQUENCY (HF) SHUNT ANTENNA PERFORMANCE

FIELD OF THE INVENTION

The present invention relates to the field of antenna technology and particularly to a boxed feed for improved high frequency (HF) shunt antenna performance.

BACKGROUND OF THE INVENTION

Currently available HF shunt antennas, which have been installed on the leading edge of a vertical stabilizer in most Air Transport Aircraft for the past forty years, have worked very well when used in conjunction with a HF coupler (ex.—an impedance tuner). However, upon installation on composite-bodied aircraft (where minimal conductive material is present in the vertical stabilizer), these currently available HF shunt antennas (which were previously spec-compliant) begin to present impedance curves that are nearly impossible for Commercial Off-The-Shelf (COTS) HF couplers (ex.—RCI CPL-920D) to tune. This is due to a lack of conductive material around the HF shunt antenna and reduced coupling between the HF shunt antenna and the aircraft structure, which reduces radiation resistance and increases the Q (ex.—increases the reactance of the HF shunt antenna) and the equivalent parallel resistance ($R_p$) of the HF shunt antenna. A traditional approach to improving $R_p$ in an HF shunt antenna has been to increase the length of the HF shunt antenna. However, this is of limited effect and often requires an unacceptable increase in the HF shunt antenna's footprint.

Thus, it would be desirable to provide an HF shunt implementation which obviates the problems associated with currently available HF shunt implementations.

SUMMARY OF THE INVENTION

Accordingly, an embodiment of the present invention is directed to a shunt antenna, including: a current return structure; a grounding structure, the grounding structure being connected to the current return structure; and a shunt plate structure, the shunt plate structure being connected to the current return structure via the grounding structure, the shunt plate structure including a first shunt plate and a second shunt plate, wherein the first shunt plate is configured in a parallel orientation relative to the second shunt plate, the first plate being connected to the second shunt plate via a plurality of contact structures.

A further embodiment of the present invention is directed to a communications system, including: a coupler, the coupler being configured for being connected to and receiving Radio Frequency (RF) signals from a radio; and a shunt antenna, the shunt antenna configured for being connected to and receiving the Radio Frequency signals from the coupler via a feed line, the coupler being configured for tuning the shunt antenna to make the shunt antenna compatible with the received RF signals, the shunt antenna including: a current return structure; a grounding structure, the grounding structure being connected to the current return structure; and a shunt plate structure, the shunt plate structure being connected to the current return structure via the grounding structure, the shunt plate structure including a first shunt plate and a second shunt plate, the first shunt plate being configured in a parallel orientation relative to the second shunt plate, the first plate being connected to the second shunt plate via a plurality of contact structures, wherein the shunt antenna is configured for radiating the Radio Frequency signals.

A still further embodiment of the present invention is directed to a method of operation of a communications system, said method comprising: receiving Radio Frequency signals transmitted from a radio, said signals being received at a High Frequency coupler of the communications system; matching the received Radio Frequency signals to a High Frequency shunt antenna of the communications system via the High Frequency coupler of the communications system; providing the matched Radio Frequency signals from the High Frequency coupler to the High Frequency shunt antenna of the communications system; receiving the matched Radio Frequency signals via the High Frequency shunt antenna and directing the matched Radio Frequency signals to a first shunt plate and a second shunt plate of the High Frequency shunt antenna; and radiating the matched Radio Frequency signals from the High Frequency shunt antenna into atmosphere (ex.—ionosphere).

It is to be understood that both the foregoing general description and the following detailed description are exemplary and explanatory only and are not necessarily restrictive of the invention as claimed. The accompanying drawings, which are incorporated in and constitute a part of the specification, illustrate embodiments of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Reference will now be made in detail to the presently preferred embodiments of the invention, examples of which are illustrated in the accompanying drawings.

Figure 1A:
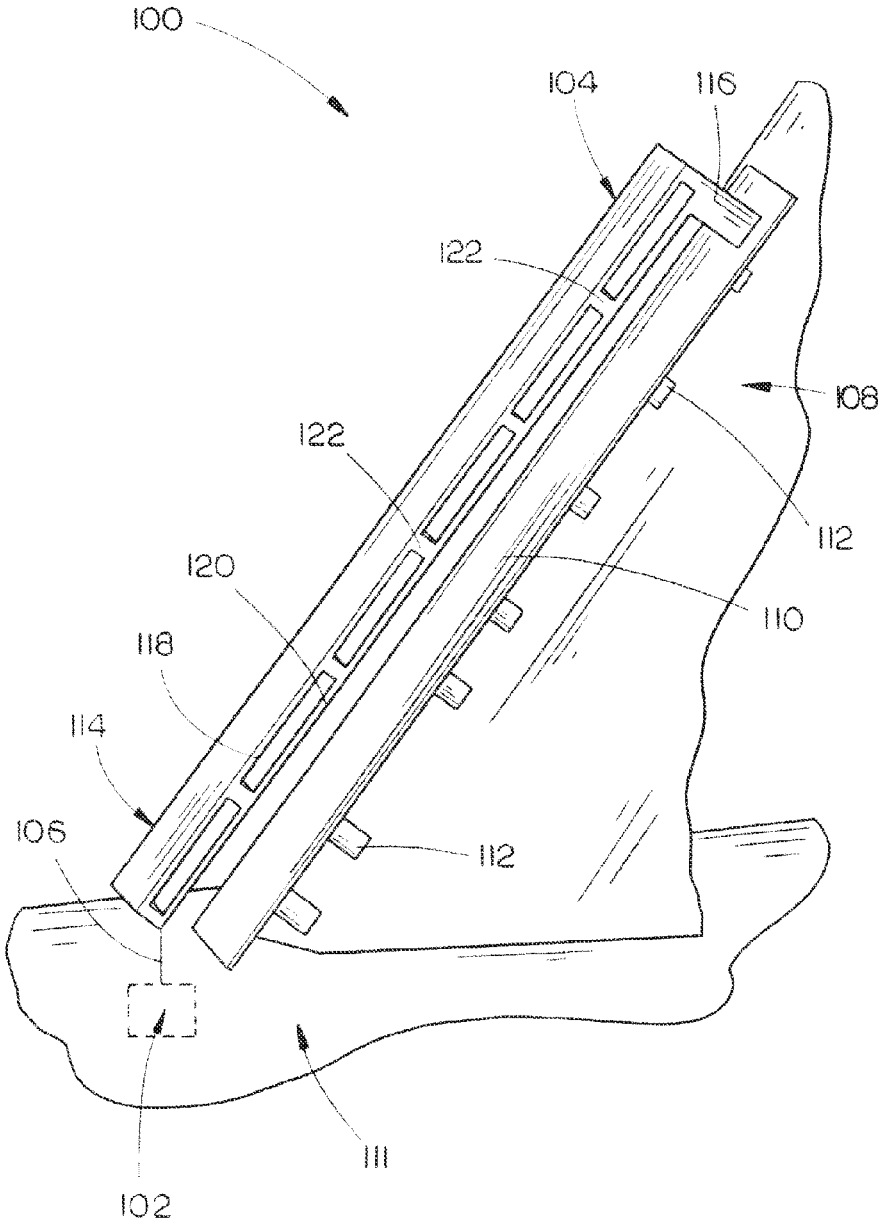
FIG. 1A is a view of a communications system in accordance with a first exemplary embodiment of the present invention, said communications system being connected to an aircraft.

Referring to FIG. 1A, a communications system (ex. —a HF communications system) 100 in accordance with an exemplary embodiment of the present invention is shown. In at least one exemplary embodiment of the present invention, HF may be defined as a set of radio frequencies ranging from 2 Megahertz to 30 Megahertz (2-30 MHz). In a current exemplary embodiment of the present invention, the HF communications system 100 may include a HF coupler 102 (ex. —an impedance tuner). For example, the HF coupler 102 may be a Commercial Off-The-Shelf (COTS) HF coupler 102. In exemplary embodiments of the present invention, the HF coupler 102 may be configured for being connected to a radio (not shown). In further embodiments of the present invention, the HF coupler 102 may be further configured for being connected to a shunt antenna (ex. —a HF shunt antenna) 104 via a feed line 106.

Radio Frequency (RF) signals may be transmitted between the radio and the HF shunt antenna 104 via the HF coupler 102. In exemplary embodiments of the present invention, the HF shunt antenna 104 is configured for transmitting and receiving RF signals. In further embodiments of the present invention, the HF coupler 102 is configured for tuning the antenna 104 to be compatible with the received signals and for tuning the radio (ex. —matching an impedance of the radio) to the antenna 104. For example, the coupler 102 may place inductive tuning elements and/or capacitive tuning elements of the coupler 102 in various configurations between the antenna 104 and the radio for tuning the antenna to be compatible with the received signals (ex. —for matching the signals to the antenna 104). Further, the HF coupler 102 may be configured for tuning an impedance of the antenna 104 and/or matching an impedance profile of the antenna 104, such that the impedance presented by said antenna 104 to the radio is compatible with a desired load of the coupler 102, thereby allowing the signals to pass undiminished to the antenna 104 from the coupler 102 (ex. —via the feed line 106). Further, the HF shunt antenna 104 may be configured for radiating the matched signals into space (exs. —air, atmosphere, ionosphere), rather than reflecting the matched signals.

In an exemplary embodiment of the present invention, the HF shunt antenna 104 may be configured for being connected to (ex. —mounted upon) a surface 108. For example, the surface may be a leading edge of a vertical stabilizer of an aircraft. In alternative embodiments, the HF shunt antenna 104 may be configured for being connected to (ex. —mounted upon) a horizontal stabilizer, or may be configured for being embedded within a wing of an aircraft. In further embodiments, the HF shunt antenna 104 may be configured for being connected to composite-bodied aircrafts (ex. —may be configured for being connected to composite vertical stabilizers of aircraft). In alternative embodiments, the HF shunt antenna 104 may be configured for being connected to aircrafts having different body types (ex. —aluminum body aircrafts). In at least one embodiment of the present invention, the HF coupler 102 may be configured for being mounted inside a fuselage 111 of an aircraft.

In current exemplary embodiments of the present invention, the HF shunt antenna 104 may include a current return structure (ex. —a current return plate) 110. In further embodiments, the current return plate 110 may be configured with one or more support structures (ex. —support brackets) 112. In exemplary embodiments of the present invention, the one or more support structures 112 may be configured for facilitating connection of (ex. —connecting) the HF shunt antenna 104 to the surface 108 and for supporting (ex. —stabilizing) the HF shunt antenna 104 upon the surface 108.

In exemplary embodiments of the present invention, the HF shunt antenna 104 may include a shunt plate structure (exs. —a feed structure, a feed, a boxed feed plate, a boxed feed) 114. In further exemplary embodiments of the present invention, the shunt plate structure 114 of the HF shunt antenna 104 may be established in a parallel orientation relative to the current return plate. In further embodiments of the present invention, the shunt plate structure 114 may be connected to the current return plate 110 via one or more grounding structures (exs. —grounding plates, shorting plates) 116.

In current exemplary embodiments of the present invention, the shunt plate structure 114 may include a first shunt plate 118 and a second shunt plate 120, the second shunt plate 120 being connected to the first shunt plate 118 (as shown in FIG. 1A). For example, the first shunt plate 118 may be connected to the second shunt plate 120 via a plurality of contact structures (ex. —bonding points, contact points) 122. In further exemplary embodiments of the present invention, the first shunt plate 118 may be established in a parallel orientation relative to the second shunt plate 120. For instance, the shunt plates (118, 120) may be oriented relative to one another and connected (ex. —via the contact structures 122) to each other in such a manner as to form a shunt plate structure 114 which is wafer-like (as shown in FIG. 1A).

Figure 1B:
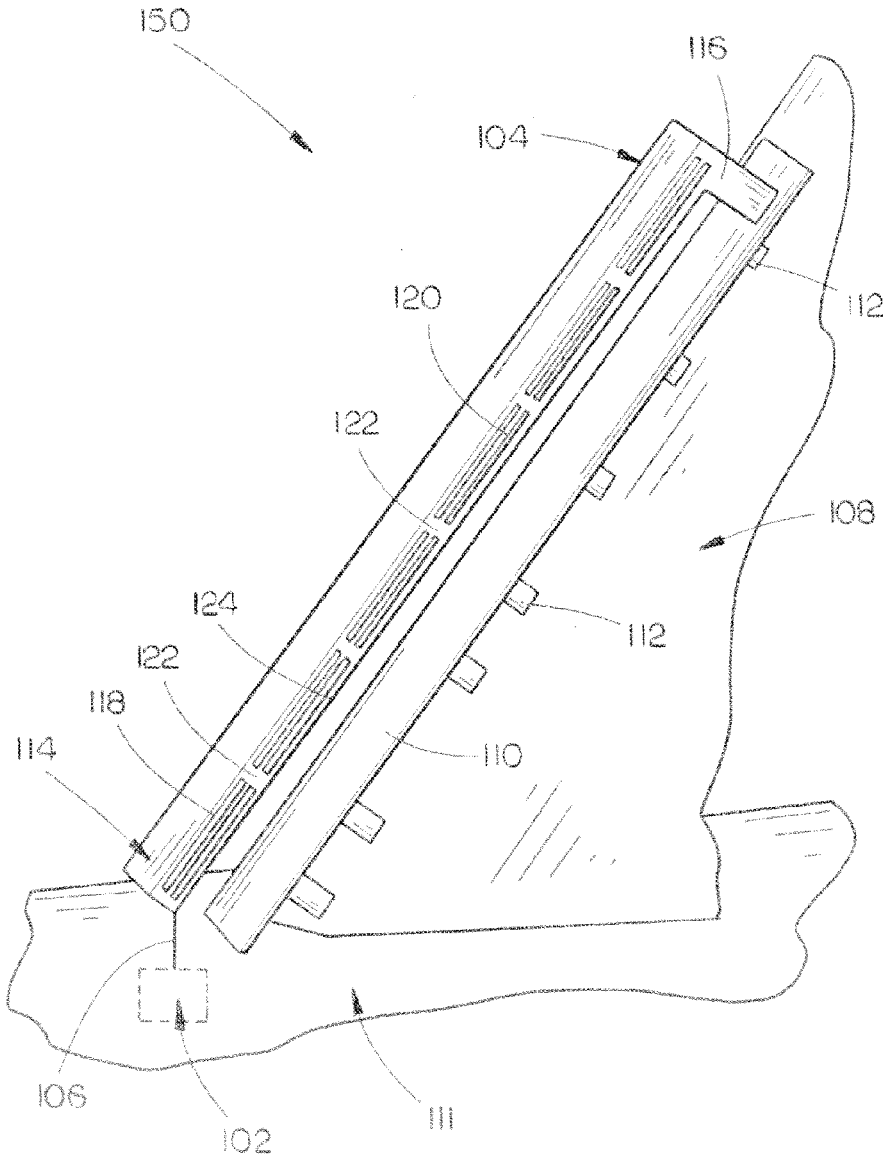
FIG. 1B is a view of a communications system in accordance with a further exemplary embodiment of the present invention, said communications system being connected to an aircraft.
Figure 2:
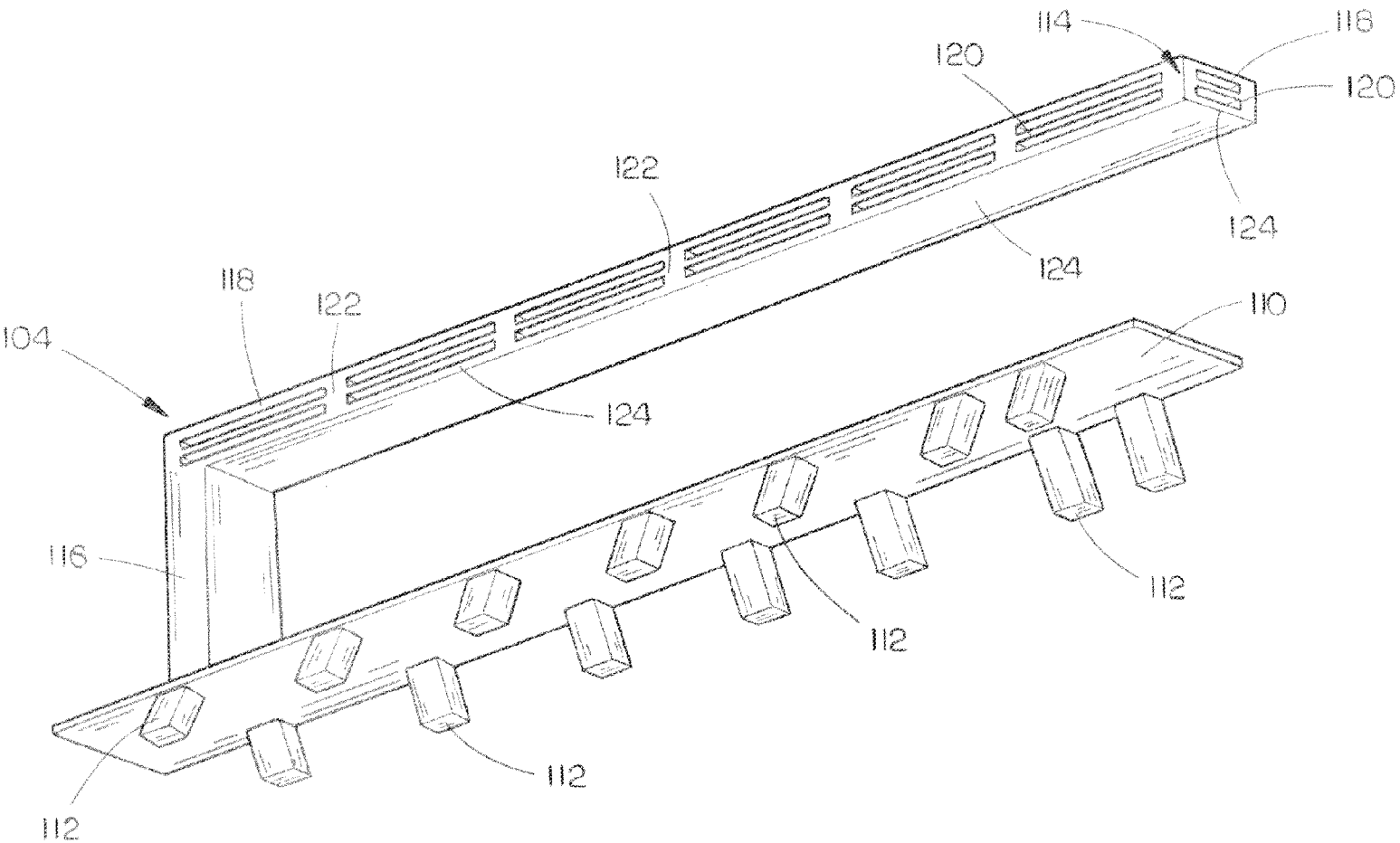
FIG. 2 is a view of a HF shunt antenna which may be configured for implementation in the communications system of FIG. 1B in accordance with a further exemplary embodiment of the present invention.

In alternative exemplary embodiments of the present invention, a communications system 150 may be provided in which the shunt plate structure 114 may include more than two shunt plates. In at least one exemplary embodiment of the present invention (as shown in FIG. 1B and FIG. 2), the shunt plate structure 114 may include a first shunt plate 118, a second shunt plate 120, and a third shunt plate 124. Further, the first shunt plate 118 may be connected to the second shunt plate 120 via contact structures 122 and the second shunt plate 120 may be connected to the third shunt plate via contact structures 122. In further embodiments, the first shunt plate 118 may be established in a parallel orientation relative to the second shunt plate 120, and the second shunt plate 120 may be established in a parallel orientation relative to the third shunt plate 124. In at least one exemplary embodiment of the present invention, the HF shunt antenna 104 may be formed of a conductive material, such as aluminum.

The expanded surface area provided by the shunt plate structure 114 described above may reduce inductance (ex. —serial inductance) and lower equivalent parallel resistance of the HF shunt antenna 104, which may thereby allow the HF shunt antenna 104 of the herein disclosed exemplary embodiments of the present invention to be spec-compliant and tunable by the HF coupler 102 and may further allow the HF shunt antenna 104 to provide improved performance over currently available shunt antenna implementations, without increasing the footprint of the antenna 104. The addition of the parallel plates (118, 120, 124) to the feed side of the HF shunt antenna 104 does not reduce the radiation efficiency of the antenna 104.

In further alternative exemplary embodiments of the present invention, the shunt antenna 104 may be configured as a wire model equivalent structure (ex. —as a wire model equivalent shunt antenna). For example, rather than including the shunt plate structure 114 having the shunt plates (118, 120) described above, the wire model equivalent shunt antenna may include a shunt structure which instead implements wires (ex. —thin wires) or wire frames placed in parallel relative to one another (rather than shunt plates). Wires may be defined to include solid or hollow extrusions of various cross-section profiles and diameters. Further, rather than implementing a current return structure 110 which is configured as a current return plate 110 (as described above), the wire model equivalent shunt antenna may be configured with a current return structure which implements a plurality of wires to provide its current return structure. For instance, two wires may be placed in parallel relative to one another, may be spaced a same distance apart as a width of the current return plate 110, and may be sized to have a same length as the current return plate 110.

Figure 3:
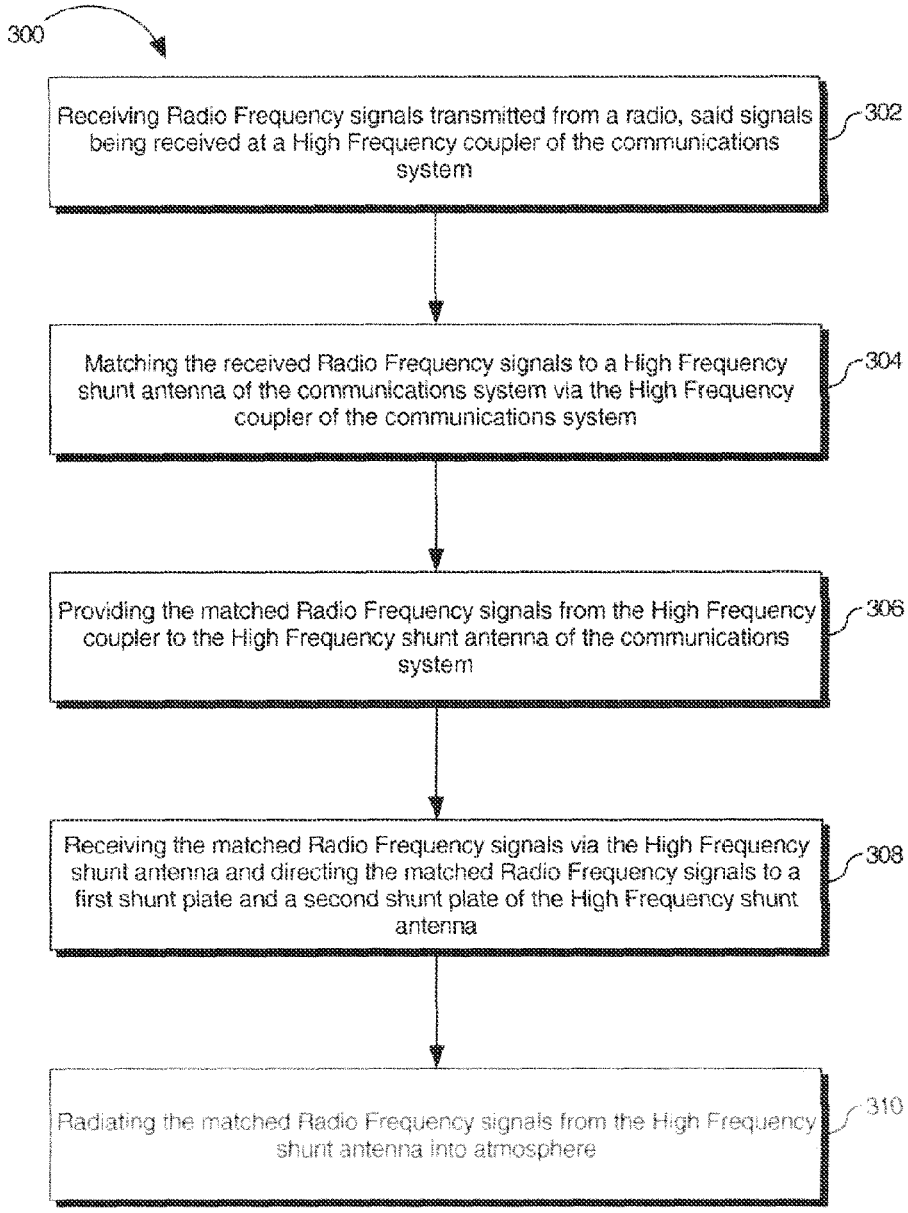
FIG. 3 depicts a flowchart illustrating a method of operation of a communications system, such as depicted in FIG. 1A and/or FIG. 1B in accordance with an exemplary embodiment of the present invention.

Referring generally to FIG. 3, a flowchart illustrating a method of operation of the communications system (100, 150) of the present invention in accordance with an exemplary embodiment of the present invention is shown. The method 300 may include the step of receiving RF signals transmitted from a radio, said signals being received at a HF coupler of the communications system 302. The method 300 may further include matching the received RF signals to a High Frequency shunt antenna of the communications system via the HF coupler of the communications system 304. The method 300 may further include providing the matched RF signals from the HF coupler (ex. —the tuned coupler) to the HF shunt antenna of the communications system 306. The method 300 may further include receiving the matched RF signals via the HF shunt antenna and directing the matched RF signals to a first shunt plate and a second shunt plate of the HF shunt antenna 308. The method 300 may further include radiating the matched RF signals from the HF shunt antenna 310. For instance, the matched RF signals may be radiated by the HF shunt antenna into the atmosphere (exs. —air, space, ionosphere).

It is understood that the specific order or hierarchy of steps in the foregoing disclosed methods are examples of exemplary approaches. Based upon design preferences, it is understood that the specific order or hierarchy of steps in the method can be rearranged while remaining within the scope of the present invention. The accompanying method claims present elements of the various steps in a sample order, and are not meant to be limited to the specific order or hierarchy presented.

It is believed that the present invention and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A shunt antenna, comprising:

a current return structure;

a grounding structure, the grounding structure being connected to the current return structure; and a shunt plate structure, the shunt plate structure being connected to the current return structure via the grounding structure, the shunt plate structure including a first shunt plate and a second shunt plate, wherein the first shunt plate is configured in a parallel orientation relative to the second shunt plate, the first plate being connected to the second shunt plate via a plurality of contact structures.

2. A shunt antenna as claimed in claim 1, wherein the shunt antenna is a High Frequency shunt antenna.

3. A shunt antenna as claimed in claim 1, wherein the grounding structure includes a plurality of support structures for facilitating mounting of the shunt antenna to a surface.

4. A shunt antenna as claimed in claim 1, wherein the shunt antenna is configured for transmitting and receiving Radio Frequency signals.

5. A shunt antenna as claimed in claim 1, wherein the shunt antenna is constructed of aluminum.

6. A shunt antenna as claimed in claim 1, wherein the shunt plate structure further includes a third shunt plate, the third shunt plate being configured in a parallel orientation relative the second shunt plate, the third shunt plate being connected to the second shunt plate via contact structures.

7. A shunt antenna as claimed in claim 1, wherein the shunt antenna is configured for connection to an aircraft surface formed of composite materials.

8. A shunt antenna as claimed in claim 7, wherein the aircraft surface is a leading edge of a vertical stabilizer.

9. A communications system, comprising:

a coupler, the coupler being configured for being connected to and receiving Radio Frequency signals from a radio; and a shunt antenna, the shunt antenna configured for being connected to and receiving the Radio Frequency signals from the coupler via a feed line, the coupler being configured for tuning the shunt antenna to make the shunt antenna compatible with the received RF signals, the shunt antenna including: a current return structure; a grounding structure, the grounding structure being connected to the current return structure; and a shunt plate structure, the shunt plate structure being connected to the current return structure via the grounding structure, the shunt plate structure including a first shunt plate and a second shunt plate, the first shunt plate being configured in a parallel orientation relative to the second shunt plate, the first plate being connected to the second shunt plate via a plurality of contact structures, wherein the shunt antenna is configured for radiating the Radio Frequency signals.

10. A communications system as claimed in claim 9, wherein the coupler is a Commercial Off-The-Shelf High Frequency coupler.

11. A communications system as claimed in claim 9, wherein the coupler is an impedance tuner configured for matching an impedance profile of the shunt antenna.

12. A communications system as claimed in claim 9, wherein the shunt antenna is a High Frequency shunt antenna.

13. A communications system as claimed in claim 9, wherein the grounding structure includes a plurality of support structures for facilitating mounting of the shunt antenna to a surface.

14. A communications system as claimed in claim 9, wherein the shunt plate structure further includes a third shunt plate, the third shunt plate being configured in a parallel orientation relative the second shunt plate, the third shunt plate being connected to the second shunt plate via contact structures.

15. A communications system as claimed in claim 9, wherein the shunt antenna is configured for radiating the Radio Frequency signals into air.

16. A communications system as claimed in claim 9, wherein the system is configured for being connected to an aircraft.

17. A communications system as claimed in claim 16, wherein the coupler is configured for being embedded in a fuselage of the aircraft.

18. A communications system as claimed in claim 17, wherein shunt antenna is configured for being mounted upon a surface of the aircraft, said surface being formed of composite materials.

19. A communications system as claimed in claim 18, wherein the surface is one of: a leading edge of a vertical stabilizer; a horizontal stabilizer; a wing.

* * * * *